US005467893A

United States Patent [19]

Landis, II et al.

[11] Patent Number: 5,467,893

[45] Date of Patent: Nov. 21, 1995

[54] STORAGE AND DISPENSING CANISTER FOR MOIST CLOTH

[75] Inventors: Henry J. Landis, II; Russel J. Landis, both of Chicago Ridge, Ill.

[73] Assignee: Sanford Corporation, Bellwood, Ill.

[21] Appl. No.: 226,960

[22] Filed: Apr. 13, 1994

[51] Int. Cl.[6] ..... B65H 1/00

[52] U.S. Cl. ..... 221/34; 206/409; 206/210; 221/61; 221/63; 221/102

[58] Field of Search ..... 221/33, 34, 61, 221/63, 102; 206/210, 409

[56] References Cited

U.S. PATENT DOCUMENTS

| | | | |
|---|---|---|---|
| 3,749,296 | 7/1973 | Harrison | 206/409 |
| 3,784,055 | 1/1974 | Anderson | 221/63 |
| 3,967,756 | 6/1975 | Barish | 221/63 |
| 4,171,047 | 10/1979 | Doyle et al. | 221/63 |
| 4,180,160 | 12/1979 | Ogawa et al. | 221/63 |
| 4,219,129 | 8/1980 | Sedgwick | 206/210 |
| 4,534,491 | 8/1985 | Norton et al. | 221/63 |
| 4,651,895 | 3/1987 | Niske et al. | 221/63 |

FOREIGN PATENT DOCUMENTS

| | | | |
|---|---|---|---|
| 0006709 | 6/1980 | European Pat. Off. | 221/63 |
| 4087967 | 3/1992 | Japan | 221/33 |
| 7900371 | 7/1980 | Netherlands | 221/63 |

*Primary Examiner*—H. Grant Skaggs
*Attorney, Agent, or Firm*—Baker & McKenzie

[57] ABSTRACT

An improved container assembly for the storage and dispensing of pre-moistened towelettes is provided. The assembly includes a container and a multi-function cap. The cap matably engages the upper end of the container and further provides an additional storage area for the storage and retention of partially used towelettes. The cap also provides a relatively airtight seal to keep the towelettes moist and prevent them from prematurely drying out. A flexibly web in the cap enables the towelettes, connected to one another by perforations, to be pulled through the web of the cap. An individual towelette is separated from the roll with a sharp jerk or tub which tears the towelette along the perforation and leaves the remaining towelette extending partially through the web. An area underneath the top closure member of the cap and the web provides a sealed area for the storage of partially used towelettes. A strap which connects the top closure member to the upper closure portion of the cap provides a handle for the initial removal of the cap from the container so that the consumer may feed the first towelette through the web. The matable engagement between the lower portion of the cap and the top portion of the container provides a secure and snug fit yet enables the cap to be removed by the consumer under relatively easy manual pressure.

4 Claims, 2 Drawing Sheets

Fig. 1.
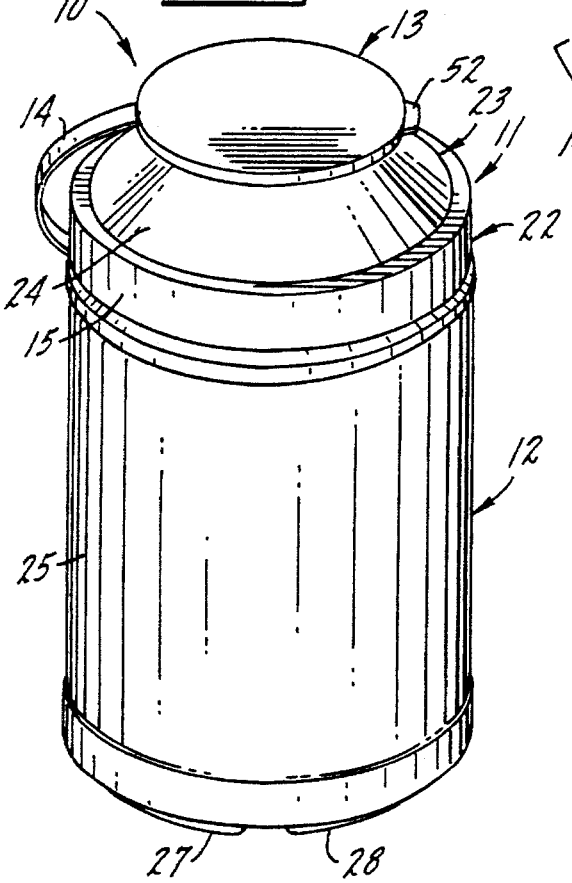
Fig. 2.
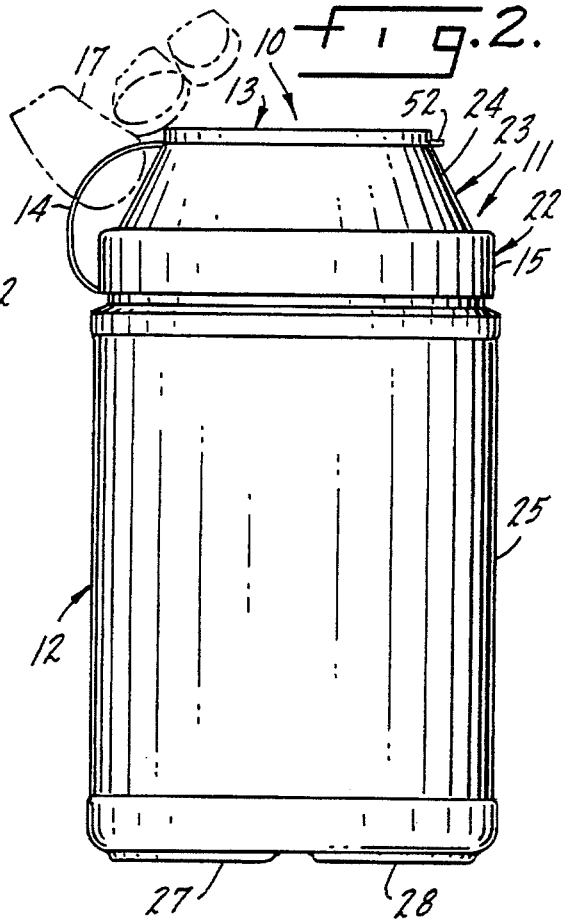
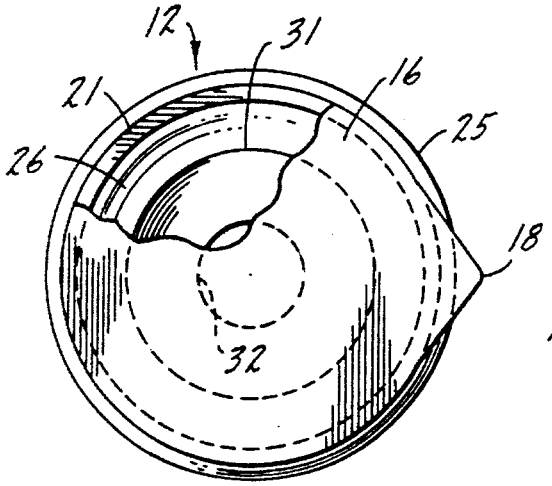
Fig. 3.
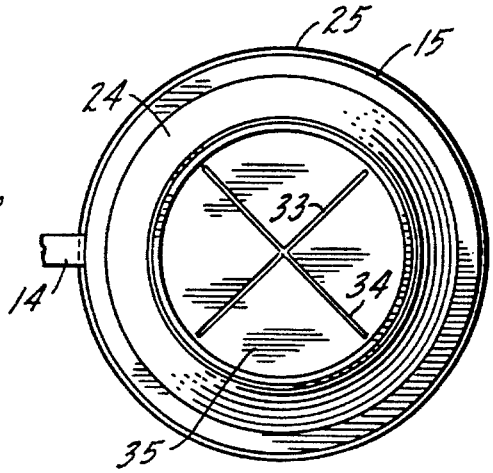
Fig. 4.

STORAGE AND DISPENSING CANISTER FOR MOIST CLOTH

FIELD OF THE INVENTION

This invention relates generally to containers and more specifically to container assemblies directed toward the dispensing of individual sheets or towelettes. The container assembly of the present invention comprises a container for accommodating a roll of towelettes and a specially designed cap. The cap is removably attached to the top of the container, includes a special compartment for the storage of partially used towelettes and further provides a means for dispensing individual towelettes.

BACKGROUND OF THE INVENTION

Moist or pre-moistened towelettes are a common and popular consumer product. Two uses for pre-moistened towelettes include baby wipes and towelettes specially designed for cleaning erasable ink off of porcelain-coated "white boards" or dry erase surfaces. Because the pre-moistened towelettes will dry upon prolonged exposure of the roll of towelettes to the atmosphere, air-tight canisters are provided for the storage and dispensing of individual towelettes. The present invention provides an improved container for this very purpose.

Specifically, two problems are associated with currently available containers for the dispensing of pre-moistened towelettes. By way of background, it should be understood that the containers or container assemblies are normally provided in two parts, a cylindrical container portion for accommodating a roll of moistened towelettes and a cap through which the towelettes are dispensed. Further, a seal in the form of a removable, protective flap is normally provided at the opening of the container to provide an airtight seal within the container to prolong the shelf life of the moist towelettes prior to purchase.

The first problem associated with currently available containers for moist towelettes is the initial opening of the container. The cap must be removed from the container so that the consumer can remove the protective flap and gain access to the towelettes. It is often very difficult to remove the cap from the container. There is normally no handle or tab for the consumer to grasp onto in order to pull the cap off the container. Further, most containers are not provided with a threaded cap/container connection. In order to remove the flap from the opening of the container to gain access to the towelettes, the consumer must first pry the cap off of the container. Then, an initial towelette is fed upward through a narrow opening in the cap through which the towelettes are dispensed.

Thus, the first problem associated with presently available container for moist towelettes is the cap/container connection. The caps are often difficult to remove from the container and the consumer must remove the cap from the container in order to gain initial access to the towelettes and feed the towelettes through a narrow opening in the cap.

A second problem associated presently available containers for pre-moistened towelettes is the lack of storage capability for partially used towelettes. Pre-moistened towelettes are expensive and consumers will be appreciative of an additional storage place within the container assembly that will accommodate partially used towelettes. This feature will be especially applicable to pre-moistened towelettes for use on dry erase boards. Often, the user of a towelette will only need to clean off a corner or a small portion of the dry erase board and will then want to save the partially used towelette. The towelettes for dry erase boards dry out quickly because they are normally moistened with a volatile solvent.

Thus, there is a need for an improved container assembly for the storage and dispensing of pre-moistened towelettes. The container assembly should include a cap that is easy to remove from the container portion so that the user can easily gain initial access to the towelettes and feed the initial towelette through the cap. Second, the cap and/or container should include a secondary container or compartment for the storage of partially used towelettes. By solving the two above-mentioned problems, the present invention provides a container assembly for the storage and dispensing of pre-moistened towelettes that is more satisfying for the consumer to use and more economical for the consumer because it conserves partially used towelettes.

SUMMARY OF THE INVENTION

The present invention solves the aforenoted problem by providing an improved container assembly for the storage and dispensing of pre-moistened towelettes. The assembly is provided in two primary parts—a container and a multi-purpose cap. Of course, a sealing flap will also be included to seal the towelettes inside the container prior to use and a roll or a plurality of towelettes will be provided inside the container.

The container is preferably of a cylindrical shape because towelettes are conveniently provided in the form of a roll with perforations separating adjacent towelettes from one another. The preferred container will include a bottom, a side wall and an open top portion. The top portion of the container includes an upper rim which defines the opening and a means for frictionally engaging the cap which is preferably disposed below the upper rim. A preferred and convenient means for frictionally engaging the cap is the inclusion of an outwardly projecting collar disposed beneath the upper rim. Suitable alternatives include at least one outwardly projecting rib, a series or ribs or protuberances thereby creating a roughened area below the upper rim to engage the cap.

The cap matably engages the top portion of the container. A lower portion of the container includes a downwardly extending side wall which matably engages the top portion of the container. In the preferred embodiment, the side wall also includes a means for frictionally engaging the top portion of the container. The means for frictionally engaging the top portion of the container may be provided in the form of a radially inwardly projecting collar that will engage the exterior surface of the upper portion of the container at or below the upper rim. Suitable alternatives to the inwardly projecting collar includes a rib, a plurality of ribs or a series of inwardly protruding projections designed to frictionally engage the top portion of the container.

In the preferred embodiment as described above, an inside surface of the cap engages an outside surface of the container and an outside surface container engages an inside surface of the cap. Of course, an alternative embodiment would be to provide a cap that fits inside the upper portion of the container, i.e. an outside surface of the cap engages an inside surface of the container, etc. Also, in the preferred embodiment, an outwardly projecting collar is disposed on the top portion of the container, below the upper rim. Further, an inwardly projecting collar is disposed on the lower portion of the cap. To matably engage the cap over the top portion of the container, the cap is forced downward, thereby forcing the inwardly projecting collar of the cap over and down past the outwardly projecting collar disposed on the top portion of the container. Thus, the inwardly projecting collar of the cap is disposed below the outwardly projecting collar of the top portion of the container. To remove the cap, enough upward force must be applied to the cap to slide the inwardly projecting collar of the cap upward and past the outwardly projecting collar of the top portion of the container. By providing a smooth, rounded, outwardly projecting collar on the top portion of the container, the cap can be matably engaged over the top portion of the container to provide a secure fit yet provide a fit that makes it relatively easy for the consumer to remove the cap from the container under normal, manual pressure.

The cap also includes an upper closure portion. The upper and lower closure portions are separated by a flexible web through which the towelettes are passed. The upper closure portion preferably includes a side wall which terminates at an open top. A closure member is provided that matably engages with the open top to seal the container shut. The space bound by the closure member, the side walls of the upper closure portion of the cap and the flexible web define a storage space that may be used to store partially used towelettes.

Preferably, the closure member is attached to the cap with a loop or strap. When the closure member is matably engaged to the open top of the cap, the loop or strap provides a handle or loop for removing the cap from the container. The consumer can simply slide one or two fingers inside the loop or strap and pull the cap upward for easy removal of the cap from the container.

The web is preferably a relatively thin piece of plastic extending across the cap between the upper closure portion and the lower closure portion. Preferably, the web includes one or more slits through which the towelettes are passed. The engagement of the towelette against the web is enough to tear the perforations thereby providing a one towelette-at-a-time dispensing system. In short, while the towelette is strong enough to pass through the web, the perforation is not and only a portion of the lower adjacent towelette extends through the web thereby making it easy for the consumer to grasp the next towelette when needed.

It is thereby an object of the present invention to provide an improved container assembly for the dispensing of pre-moistened towelettes.

Yet another object of the present invention is to provide an improved container assembly for pre-moistened towelettes with a cap that may be easily removed by the consumer.

Still another object of the present invention is to provide an improved container assembly with a compartment for storing partially used towelettes.

Other features and advantages of the present invention will appear from the following description in which one embodiment has been set forth in detail in conjunction with the accompanying drawings.

BRIEF DESCRIPTION OF THE DRAWINGS

This invention is illustrated more or less diagrammatically in the accompanying drawing, wherein:

FIG. 1 is a perspective view of a container assembly made in accordance with the present invention;

FIG. 2 is a side elevational view of the container assembly shown in FIG. 1;

FIG. 3 is a top view of the container assembly shown in FIG. 1 with the cap portion removed;

FIG. 4 is a partial top view of the container assembly shown in FIG. 1 with the top closure member in an open position thereby exposing the flexible web disposed therebelow.

Figure 5:
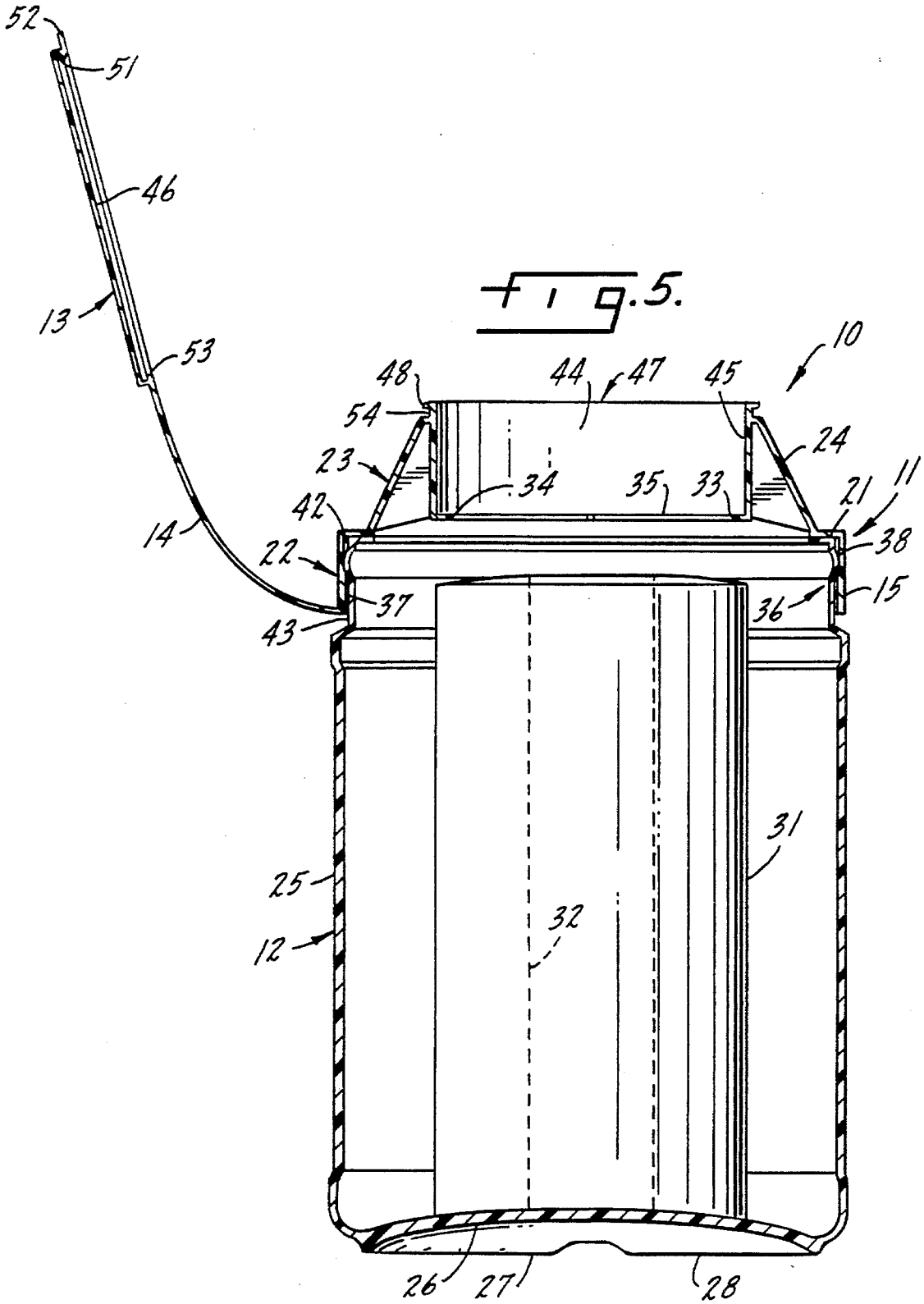
FIG. 5 is side sectional view of the container assembly first shown in FIG. 1 and with the top closure member in an open position.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE INVENTION

Like reference numerals will be used to refer to like or similar parts from Figure to Figure in the following description of the drawing.

As shown in FIG. 1, the container assembly indicated generally at 10 includes a cap 11 and a container 12. The cap 11 is matably engaged over the top portion of the container 12. The cap 11 also includes a top closure member 13 which is attached to the cap 11 with a strap 14. The strap 14 is connected to a lower end of the side wall 15 and, as shown in FIG. 2, provides a convenient loop or handle for the consumer to insert a finger 17 through when removing the cap 11 from the container 12.

Turning to FIGS. 2 and 3 collectively, it will be noted that the pre-moistened towelettes 31 are kept moist or fresh with the sealing flap indicated at 16 in FIG. 3. After purchase, the consumer removes the cap 11 by inserting a finger 17 (see FIG. 2) through the loop created by the strap 14 and pulls the cap 11 upward and off of the container 12. Then, the consumer may easily grab the tab 18 to remove the seal 16 from the upper rim 21 of the container 12.

The flap 16 provides a hermetic seal which keeps the roll of moistened towelettes 31 moist and fresh prior to use and also enables the assembly 10 to have a long shelf-life. The flap 16 is air-impervious and precludes atmospheric communication with the interior of the container 12. The use of the sealing flap 16 is necessary because articles manufactured from injection-molded plastic do not provide adequate sealing mechanisms as discussed below with respect to FIG. 5.

Returning to FIG. 2, as seen in the side view of the cap 11 shown in FIG. 2, the cap 11 can be divided into a lower closure portion 22 and an upper closure portion 23. The lower closure portion 22 matably engages the top portion of the container 12. The upper closure portion 23 features a slanted side wall 24. The container 12 also features a side wall 25 and a bottom 26. Support footings are indicated at 27, 28.

Turning again to FIG. 3, the container 12 accommodates a roll of towelettes 31. After purchase, the consumer removes the cap 11 from the container 12 as illustrated in FIG. 2 and then pulls upward on the tab 18 of the sealing flap 16 to expose the roll of towelettes 31. Then, the consumer grasps a towelette from the inside 32 of the roll 31 and feeds an initial towelette through the slits 33, 34 of the flexible webbing 35 as shown in FIG. 4. Then, the cap 11 is replaced on the top portion of the container 12 with the initial towelette fed through the webbing 35. A series of perforations separates the individual towelettes of the roll 31 of towelettes. A sharp upward tug on a towelette through the webbing 35 will cause the perforation to break at or slightly above the webbing 35 thereby providing a one towelette-at-a-time dispensing system. The lower towelette is broken off and remains partially extending through the webbing 35 so that it may be easily grasped by the consumer when another towelette is needed.

Turning to FIG. 5, a detailed sectional view of the container assembly 10 is provided. Turning first to the cap indicated generally at 11, the cap 11 is divided into an upper closure portion 23 and a lower closure portion 22 by the flexible web 35. Towelettes, one at a time from the roll 31 of towelettes, are passed through the slits 33, 34 and the web 35 (see FIG. 4). It will be noted that the sidewall 45 has substantially the same diameter as the roll of towelettes 31. The width of the diameter of the sidewall 45 is important so that the storage area 44 which is defined by the sidewall 45, the web 35 and the open top 47, is sufficiently large enough to hold one or more partially used towelettes. In the configuration shown in FIG. 5, the storage chamber 44 is sufficiently large enough to hold at least two towelettes. Also shown in FIG. 5 is the frustum-shaped brace 56 which extends between the upper closure portion 23 and the lower closure portion 22. The brace 56 serves to support the sidewall 45.

The lower closure portion 22 of the cap 11 matably engages the top portion 36 of the container 12. The lower closure portion 22 features an inwardly extending collar or protuberance 37. When engaged, the inwardly protruding collar 37 is disposed below the outwardly protruding collar or protuberance 38 disposed in the top portion 36 of the container 12. The collar 38 is disposed below the upper rim 41 of the container 12. Because the cap 11 is made of resilient plastic material, the collar 37 may be forced over the collar 38 under manual pressure. Further, as shown in and discussed above with respect to FIG. 2, the collar 37 may be pulled up and over the collar 38 under manual pressure. However, the engagement between the collar 38 of the container 12 and the receiving section 42 of the cap 11 in combination with the engagement between the collar 37 of the cap 11 against the collar 38 provides a snug and secure fit of the cap 11 on top of the container 12. Further, depending on the material used to fabricate the cap 11 and the container 12, it may be desirable to provide abutting or near abutting engagement between the collar 37 and the receiving section 43 disposed below the collar 38 on the container 12.

Turning to the upper closure portion 23 of the cap 11, a storage compartment indicated generally at 44 is provided within the area defined by the side wall 45, the web 35 and the under surface 46 of the top closure member 13 when the top closure member is in a closed position as shown in FIG. 1. The storage area 44 provides a convenient place for the storage of partially used towelettes thereby making the container assembly 10 an economical way to dispense pre-moistened towelettes and store partially used towelettes. The closure member 13 provides a relatively airtight seal when it is matably engaged over the open top 47 of the cap 11. Specifically, the flange 48 snaps into the groove or slot 51 provided in the top closure member 13. The flange 53 of the top closure member 13 is accommodated in the receiving area 54 of the cap 11. The top closure member 13 is easily removed by grasping the tab 52 with a thumb or finger. Further, the top closure member 13 provides a snapping sound when it is closed to tell the consumer that the top 13 is properly closed.

It will also be noted that to "start" the roll of towelettes 31, the cap 11 is pulled off of the container 12, the flap 16 is removed from the upper rim 41 and a towelette is grasped from the inside 32 of the roll 31. The initial towelette is then fed upward through the web 35. After the towelette is fed through the web, then the cap 11 may be pushed back down onto the top portion 36 of the container 12 to provide the matable engagement illustrated in FIG. 5. In the alternative, the consumer's fingers may be fed downward through the webbing 35 to grasp an end towelette off of the roll 31 and the end towelette may be pulled upward through the slits 33, 34 and past the webbing 35.

It will be understood that additional means for frictionally engaging the cap 11 other than the collar 38 are available. Specifically, a series of outwardly projecting protuberance could be provided or a plurality of ribs. Further, other means for frictionally engaging the top portion 36 of the container 12 are available other than the inwardly extending collar 37. Again, inwardly extending protuberances, ribs or the like may be provided. A cap could be provided to fit inside of the upper rim 41 as opposed to outside as shown in the Figures. Further, any top closure member 13 that seals the open top 47 will be suitable. The important aspect is to provide a relatively airtight seal to preclude the drying out of the pre-moistened towelettes 31.

However, it will be noted that the cap engaging means 38 and the container engaging means 37 do not provide a truly air-tight seal and therefore the use of a foil seal 16 which provides a true hermetic seal is necessary in order to provide a long shelf-life for the product. FIG. 5 also provides an illustration of the lower or first portion 22 of the cap 11 and the upper or second portion 23 of the cap 11. The second portion 23 providing the chamber 44 for the storage of at least one used towelette. The chamber 44 is defined as the space between the flexible chamber bottom 35 and the closure member 13 when the closure member 13 is in the closed position as illustrated in FIGS. 1 and 2. The strap or strap means 14 forms a loop as shown in FIG. 2 which is sufficiently open to enable the user's finger 17 to be easily inserted therethrough. Then, the user can exert an upwardly directed separating force on the strap 14 which results in removal of the cap 11 from the container 12 without removal of the top closure member 13 from the cap 11. Specifically, the top closure member 13 is sufficiently wide enough and securely attached to the cap 11 so that an upward separating force imposed on the strap 14 will not result in removal of the top closure member 13 from the cap 11. Rather, an upward separating force on the strap 14 will only result in removal of the cap 11 from the container 12. Thus, the strap 14 provides a unique one-purpose handle which results only in the removal of the cap 11 from the container 12 and not the removal of the top closure member 13 from the cap 11. An upward separating force on the strap 14 will not result in removal of the top closure member 13 primarily because of the width of the top closure member 13. Specifically, the large circumference of the top closure member 13 enables it to be securely attached to the cap 11 which precludes it from being removed from the cap 11 via the strap 14. Thus, the width of the top closure member 13 provides two advantages: first, it enables the strap 14 to be used as a handle to remove the cap 11 from the container 12; and second, the width of the top closure member 13 defines a wide chamber 44 which provides a means for storing a partially used towelette.

Although only one embodiment of the present invention has been illustrated and described, it will at once be apparent to those skilled in the art that variations may be made within the spirit and scope of the invention. Accordingly, it is intended that the scope of the present invention be limited solely by the scope of the hereafter appended claims and not by any specific wording in the foregoing description.

We claim:

1. A combination container and towelette assembly with moisture-retaining freshness seal for the storage and dispensing of moist towelettes, the assembly comprising:

an injection molded plastic cylindrical container for accommodating a cylindrical roll of towelettes inside the container, the container including a bottom, a sidewall and an open top portion, the top portion including an outwardly projecting collar, the sidewall of the container having an inside diameter that is substantially wider than the diameter of the roll of the towelettes, a removable factory-installed moisture-retaining freshness seal disposed on the open top portion of the container for sealing the roll of towelettes inside the container and protecting the towelettes from exposure to the atmosphere, an injection molded plastic cap for matably engaging and sealing the top portion of the container, the cap including a lower closure portion including an inwardly projecting collar, the inwardly projecting collar of the lower closure portion of the cap being disposed below the outwardly projecting collar of the top portion of the container when the cap is matably engaged over the top portion of the container, the cap also including an upper closure portion disposed above the lower closure portion, a flexible web disposed between the upper closure portion and the lower closure portion, an open top and a top closure member, the upper closure portion including an interior sidewall extending from the flexible web upward to the open top, the interior sidewall having a diameter at least as wide as the diameter of the roll of towelettes, the top closure member for matably engaging the open top of the upper closure portion, the web including a first slit and a second slit that intersect one another for passing towelettes through the web, the first and second slits enabling towelettes to be passed from the container through the web to the upper closure portion by the consumer, an area bound by the top closure member, the interior sidewall of the upper closure portion and the flexible web providing an area sufficiently large enough for the storage of a plurality of partially used towelettes, the strap attaching the top closure member to the cap, the strap forming a loop when the top closure member is matably engaged with the open top of the cap, manual tension applied to the strap adjacent to a first point where the strap is connected to the cap enabling the inwardly projecting collar of the lower closure portion of the cap to be pulled over the outwardly projecting collar of the top portion of the container thereby removing the cap from the container.

2. The combination container and towelette assembly of claim 1, wherein a frustum-shaped brace extends between the upper and lower closure portions of the cap to provide support for the interior sidewall of the upper closure portion of the cap.

3. A consumer actuated, hermetically sealed combination container and towelette assembly for the dispensing of moist towelettes and for the storage of partially used towelettes, said container assembly comprising:

a cylindrical container including a closed bottom, a sidewall, an open top, and an upper rim for accommodating a supply of moist towelettes, said towelettes being provided in the form of a cylindrical roll, the cylindrical roll having a diameter that is substantially narrower than the diameter of the sidewall of the container, said supply of moist towelettes recessed within the container, a removable factory-installed moisture-retaining freshness seal disposed on the open top of the container for sealing the roll of towelettes inside the container and protecting the towelettes from exposure to the atmosphere, cap engaging means disposed on the upper outside wall of the container for engaging a cap, said cap including a first portion having means carried therefor engaging the cap engaging means of the container, said cap including a second portion extending upwardly from the first portion, said second portion including an upwardly protruding sidewall, said upwardly protruding sidewall including a diameter that is at least as wide as the diameter of the roll of towelettes, said second portion of said cap further including a removable and connectable closure member which engages and closes off the second portion of the cap to form a chamber sufficiently large enough for a plurality of partially used moist towelettes, a flexible chamber bottom carried by the first portion of the cap and dispersed above the sealing member when the cap and container are in a factory assembled, pre-use condition, said flexible chamber bottom, second portion of the cap and closure member forming a chamber for storage of partially used moist towelettes, said flexible chamber bottom including at least two slits to thereby form at least two flaps which may be easily parted by the consumer by projecting fingers downwardly therethrough, the closure member is non-separably connected to the cap by strap means, said strap means forming a loop between the cap and the closure members, said loop further being sufficiently open adjacent its connection to the cap to enable a user's finger to be easily inserted therein adjacent the cap and exert a separating force sufficient to remove the cap from the container, but insufficient to separate the closure member from the cap, whereby a consumer, after initial removal of the cap followed by removal of the sealing member, may easily grasp an end of the supply of moist towelettes and pull said end upward past the flexible bottom preparatory to separation from the balance of the supply of moist towelettes, and use.

4. The combination container and towelette assembly of claim 3, wherein a frustum-shaped brace extends between the first and second portions of the cap to provide support for the upwardly protruding sidewall of the second portion of the cap.

* * * * *